United States Patent [19]

Martinez

[11] 3,973,646

[45] Aug. 10, 1976

[54] LADDER FOR SWIMMING POOLS, AND THE LIKE

[75] Inventor: Rudolph J. Martinez, North Royalton, Ohio

[73] Assignee: Portable Pool Covers, Inc., Berea, Ohio

[22] Filed: Mar. 4, 1974

[21] Appl. No.: 447,554

Related U.S. Application Data

[63] Continuation-in-part of Ser. No. 343,355, March 21, 1973, abandoned.

[52] U.S. Cl. ..... 182/97; 182/106

[51] Int. Cl.[2] ..... E06C 9/08

[58] Field of Search ..... 182/86, 97, 98, 99, 182/106, 118, 206, 27; 403/92, 102, 79, 157, 96, 93; 4/172.13, 172.15

[56] References Cited

UNITED STATES PATENTS

| | | | |
|---|---|---|---|
| 2,024,039 | 12/1935 | Harting | 182/27 |
| 2,601,999 | 7/1952 | Sly | 403/96 |
| 2,763,517 | 9/1956 | Strand | 403/96 |
| 2,974,746 | 3/1961 | Baker | 4/172.15 |
| 3,092,844 | 6/1963 | Brunson | 4/172.13 |
| 3,483,999 | 12/1969 | Barret | 182/155 |
| 3,498,410 | 3/1970 | Storch | 182/206 |
| 3,586,124 | 6/1971 | Kunzweiler | 182/97 |

*Primary Examiner*—Reinaldo P. Machado
*Attorney, Agent, or Firm*—Cain and Lobo

[57] ABSTRACT

An improvement in an access ladder for swimming pools allowing the ladder to be pivoted into and out of the interior of the swimming pool while remaining securely mounted at the surface of the pool. Ingress and egress to the pool are provided by extending the ladder into the pool, while cleaning, covering and winterizing the pool are more easily accomplished by pivoting the ladder out of the pool interior.

4 Claims, 7 Drawing Figures

LADDER FOR SWIMMING POOLS, AND THE LIKE

CROSS-REFERENCE TO RELATED APPLICATIONS

This application is a continuation-in-part of applicant's copending Ser. No. 343,355, filed Mar. 21, 1973 now abandoned.

BACKGROUND OF THE INVENTION

1. Field of the Invention

The present invention relates generally to access ladders for swimming pools, and the like, and more particularly, to a ladder pivotally mounted at the side of a swimming pool for being positioned either in or out of the interior portions of the pool.

2. Description of the Prior Art

Ladders positioned at the exterior walls of swimming pools to allow ingress and egress of the users of the pools are common in the art. In such cases, one end of the ladder is usually permanently mounted, by means of bolts or other such devices, into the deck immediately adjacent to the exterior walls of the pool. The ladder is then constructed in such a manner as to extend over the deck and down into the pool. The other end of the ladder is positioned below the level normally attained by water in the pool. This lower end of the ladder is either permanently mounted to the adjacent wall of the pool or at least arranged to be in contact with the wall to thus support a person attempting to enter or leave the pool by way of the ladder.

Ladders, such as the one just described, present problems with regard to cleaning, refinishing, covering and winterizing the swimming pool. Although, any problems encountered as a result of the presence of the ladder in the interior of the pool may be met by either working around the ladder or unfastening the permanent mountings of the ladder, these solutions still result in unattained goals. In the cases of refinishing, winterizing or any other process generally performed only once in a season, removing the ladder represents a manageable but undesirable solution to the problem. Certainly, when performing such frequently necessary operations as cleaning and covering the pool, unfastening a permanently mounted ladder becomes an extremely unattractive solution.

Particularly with regard to a flexible, unrollable swimming pool cover as described more fully in U.S. patent application Ser. No. 343,355 filed Mar. 21, 1973, a permanently mounted ladder extending into the pool presents problems in attempting to unroll the cover to effectively prevent pollution of the water in the pool.

SUMMARY OF THE INVENTION

The general object of this invention is to provide a new and improved ladder and mounting therefor for swimming pools, and the like.

Other objects of this invention include a new and improved swimming pool ladder capable of attaining a position with respect to the interior of the pool which assists in the processes of cleaning, refinishing, winterizing or covering the swimming pool by reason of the remoteness of the ladder from the interior of the pool, while remaining securely attached to a structure permanently, positionally related to the swimming pool.

Still other objects of this invention include a new and improved access ladder for swimming pools alternately positionable either within the confines of the vertical walls of the pool to thereby assist in entry into and exit from the water normally contained in the swimming pool by a user thereof, or without the confines of the vertical walls of the pool to facilitate maintenance functions necessary with regard to the interior of the pool during which the presence of any structure internal to the vertical walls of the pool, such as a ladder, would constitute a deterrent or substantial barrier to the efficient maintenance of the swimming pool.

A further object of this invention involves the elimination of problems particularly prevalent in covering a swimming pool as a direct result of either long term or short term non-use of the pool, with regard to special procedures necessitated by the presence of one or more access ladders permanently affixed to the structure immediately surrounding a swimming pool requiring either special adapters for the cover to effectively enclose the ladders or physical detachment of the ladders from the permanent mountings.

Other objects of this invention include the provision of a new and improved ladder for access to swimming pools which further includes pivoting joints connecting the ladder to the swimming pool; which allows the ladder to be positioned operatively and inoperatively; and, which manually or automatically results in the latching of the ladder in one of a number of positions.

A still further object of this invention includes a new and improved ladder for access to swimming pools which allows positioning of the ladder remote from the interior portions of the swimming pool, while maintaining permanent attachment of the ladder, in a manner and orientation resulting in the ladder being additionally self-storing without further requirements of providing for the placement thereof.

Yet another object of the present invention includes a new and useful improvement in ladders commonly used for access to and from swimming pools, involving utilizing the structure of most present, permanently mounted ladders to effect a remounting of the ladders through the teachings of the present invention to realize any one or all of the above stated objects.

A still further object of this invention is to provide a new and improved swimming pool access ladder which obtains one or more of the objects and advantages set forth above.

These and other objects and advantages of this invention will become apparent from the following description thereof, in view of the accompanying drawings.

DESCRIPTION OF THE PREFERRED EMBODIMENTS

Figure 1:
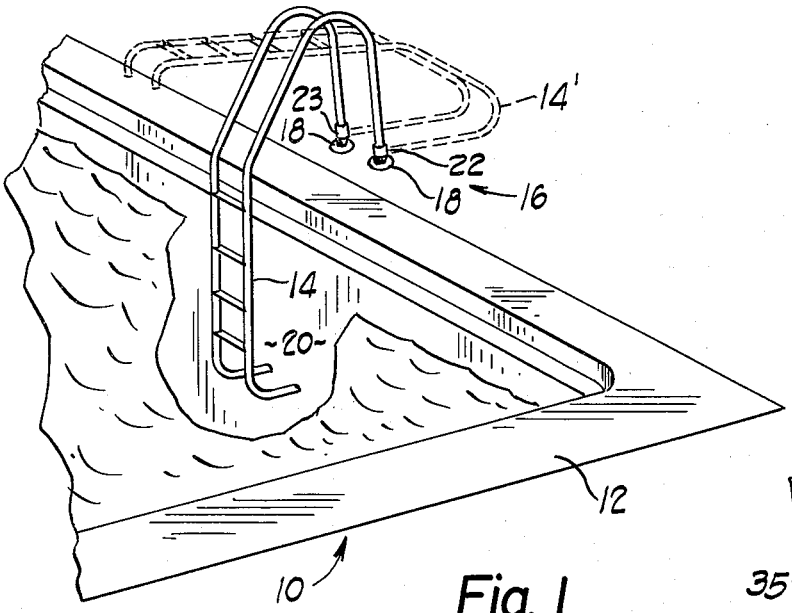
FIG. 1 is a partial perspective fiew of a swimming pool including a ladder embodying a preferred form of this invention.

FIG. 1 illustrates generally at 10, a swimming pool of a type commonly known in the art. A deck 12, generally an integral part of the pool, surrounds the swimming pool 10. A ladder 14, constructed much like any ordinary swimming pool ladder, is attached to either the deck 12 or to a surface indicated generally at 16, immediately adjacent to the deck 12. In this regard, one end of the ladder 14 is permanently attached by means of bolts, screws or other suitable mounting hardware at points 18 and 19 to either the deck 12 or the adjacent surface 16. In the case of the present embodiment, the remaining end of the ladder 14 is not attached to the swimming pool 10 in any manner, but rather is arranged to simply rest in abutting contact with a vertical wall 20 of the swimming pool 10 at points normally below the surface of water in the pool.

With the ladder 14 positioned as described above, a person using the swimming pool 10 is able to enter or exit the swimming pool by utilizing the ladder 14. The ladder 14 supports the weight of a person as a result of the permanent mounting at points 18 and 19, and the abutting relationship of the remaining end of the ladder and the wall 20 of the pool. This arrangement of the ladder 14 therefore represents an operative position for the ladder.

Included in FIG. 1 is a characterization, indicated at 14' in phantom lines, of the ladder as it appears in this embodiment when in a raised or inoperative position. As is readily apparent from the figure, the structure of the ladder is arranged to be pivoted in one direction, perpendicular to the wall 20 of the swimming pool 10, in order to be removed from the interior of the pool.

In order to obtain these and other objects of this invention, the ladder 14 includes a plurality of uni-directional pivoting joints 22 and 23 between the ends of the ladder 14 and the mounting points 18 and 19 at which the ladder is normally secured at the surface of the swimming pool 10. In this manner, the ladder 14 is permitted to be pivoted between a position wherein the ladder is in contact with the wall 20 of the pool and some point wherein all portions of the ladder 14 are removed from the pool 10.

Figure 2:
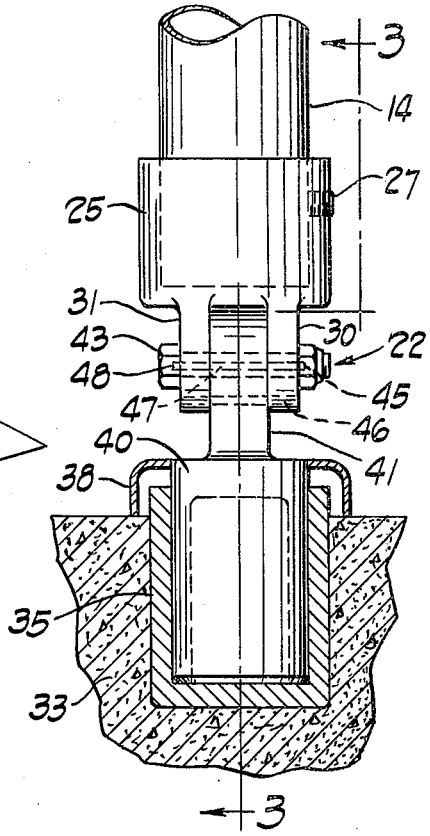
FIG. 2 is a partial schematic detail of a vertical section of the ladder shown in FIG. 1 showing one form of the embodiment of this invention.

FIG. 2 illustrates one form of what could be either of the uni-directional pivoting joints 22 or 23. For reasons of explanation only, uni-directional pivoting joint 22 is discussed with the understanding being had that both of the joints 22 and 23 are constructed alike and operate similarly. In FIG. 2, one end of the ladder 14, shown as a tubular structure, is securely fastened to an upper adapter 25 by the employment of any suitable fastening device 27, i.e., set screw or bolt, for example. Extending from the upper adapter 25 and forming an integral part thereof is a socket-like structure consisting of two side walls 30 and 31 separated by a distance sufficient for the acceptance of a mating structure.

FIG. 2 includes an area 33 intended to represent the construction material of either the deck 12 or the surface 16 immediately adjacent the pool 10 to which the ladder 14 is permanently attached. A socket 35 is permanently embedded into the area 33 in the case of some applications of access ladders to swimming pools. The socket 35 is intended, ordinarily, to receive the end of the ladder 14 in which case a locking bolt 36 (shown in FIG. 3) secures the ladder into the socket 35. A cover 38 is installed over the socket 35 and locking bolt 36 for the purpose of concealing these portions for reasons of aesthetics.

In the case of the present invention, the socket 35 is used to accept a lower adapter 40 which is secured into the socket 35 by way of the locking bolt 36. As before, the cover 38 is utilized to conceal the socket 35 and bolt 36. The lower adapter 40 is constructed so as to have a flange 41 formed as an integral part of the lower adapter, extending outwardly from the lower adapter 40. This flange 41 is intended to be positioned between the side walls 30 and 31 of the upper adapter 25 to thus provide the mating structure mentioned. In this manner, concentric holes are provided in each of the side walls 30 and 31 and the flange 41 through which a connecting bolt 43, or other suitable hardware, is inserted to render the upper adapter 25 and lower adapter 40 permanently engaged as long as the bolt 43 so remains.

Figure 3:
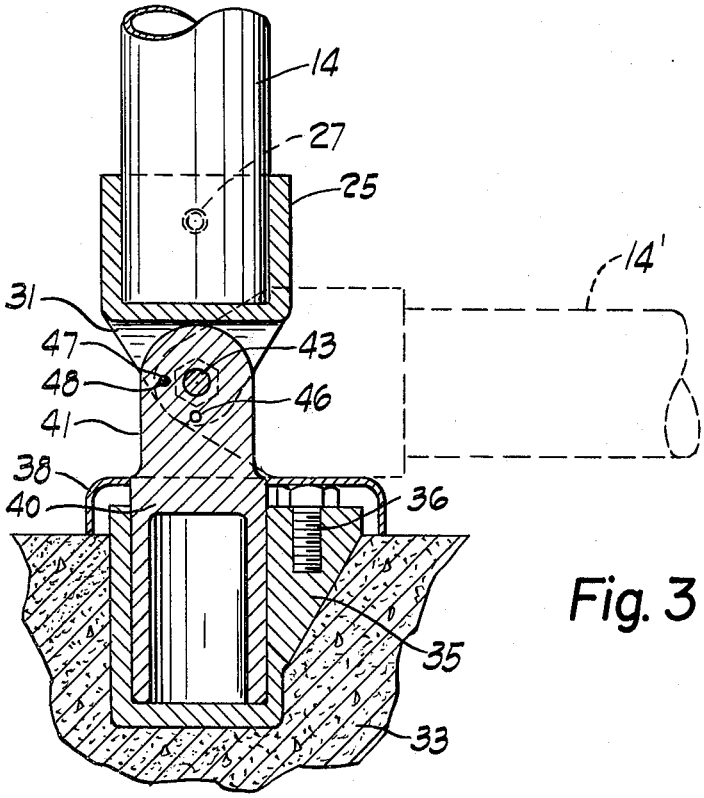
FIG. 3 is a vertical cross section taken substantially along line 3—3 in FIG. 2.

The position of the ladder 14 as illustrated in FIG. 2 results in the ladder being in an operative position. FIG. 3, while primarily illustrating the ladder 14 in an operative position, also shows in phantom lines an inoperative 14' position of the ladder. This figure lends itself to a demonstration of the stable states obtainable by the uni-directional pivoting lines 22 and 23 and the ladder 14.

Although the ladder 14 is capable of obtaining an infinite number of positions as a result of the uni-directional pivoting joints 22 and 23, only a finite quantity of these positions afford any real advantage to the invention. These finite positions are considered stable states since the ladder 14 is desired to remain temporarily stationary while in any one of the finite positions. The requirement of remaining temporarily stationary while in a stable state is a direct consequence of the usefullness of the ladder 14.

Thus, the operative position results in the ladder 14 being extended into the swimming pool 10 at which point the ladder must be temporarily stationary in order that a weight disposed onto the ladder be supported without incurring any risk of unwanted mobility. Likewise, when the ladder is in the inoperative position, the ladder 14' is desired to remain removed from the interior of the pool without further need of restraint of movement. This requirement results in the ability to allow cleaning or refinishing of the interior of the pool or covering of the pool area without concern for adverse effects caused by the ladder 14. Such adverse effects include interference with cleaning or refinishing and possibly damaging a cover for the pool.

The side walls 30 and 31 of the upper adapter 25 have concentric holes provided through both members at two positions indicated 45 and 46. The flange 41 of the lower adapter 40 has only one hole in the position indicated at 47. A locking pin 48 is constructed to be of a smaller diameter than any of the holes 45, 46 and 47 so that the locking pin when inserted through either 45 and 47 or 46 and 47 provides a locking function resulting in two stable positions for the ladder 14. As illustrated in FIGS. 2 and 3, when the locking pin 48 is inserted through holes 45 and 47, the ladder 14 is maintained in what has been defined above to be the operative position. Conversely, as shown in phantom in FIG. 3, when the locking pin 48 is inserted through holes 46 and 47, the ladder 14' is maintained in the inoperative or raised position.

Although the discussion herein has considered the construction of the uni-directional pivoting joints 22 and 23 to include a socket composed of the two side walls 30 and 31 as part of the upper adapter 25 and a corresponding mating structure consisting of the flange 41 as part of the lower adapter 40, it should be understood that these arrangements are not exclusive. The present invention contemplates a plurality of structures, of any design allowing pivoting with respect to the opposite ends thereof, connecting a ladder, or the like, to a permanent fixture in a manner allowing pivoting joints 22 and 23 may be reversed, both or only one, with respect to the orientation shown in the figures as concerns the connection thereof to the ladder 14 and the deck 12 or adjoining structure 16.

The uni-directional pivoting joints 22 and 23 may have any one or more suitably alternative pivoting devices substituted therefore. The only restrictions regarding any such substitution involve first, maintaining the axis of rotation of the substituted devices substantially in an identical line with regard to each other. And second, arranging the pivoting devices substituted so that all such devices pivot in the same direction and at least through the distance necessary to obtain the stable positions. Any other situation could result in the ladder 14 not being readily pivotable.

Figure 4:
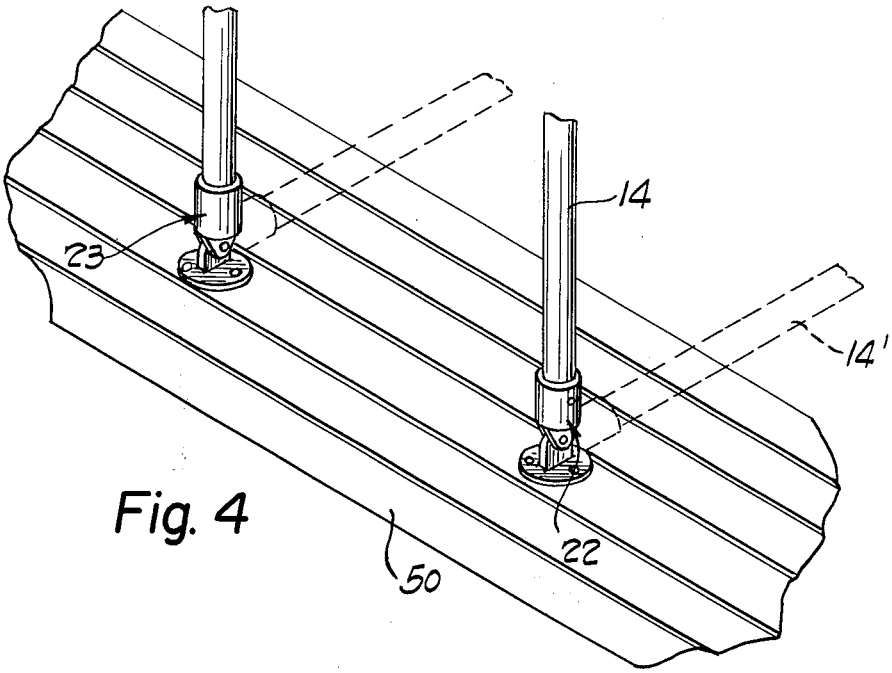
FIG. 4 is a partial perspective view illustrating another preferred embodiment of this invention.
Figure 5:
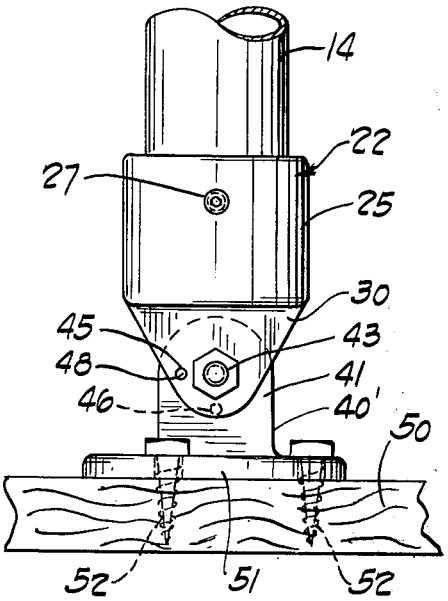
FIG. 5 is a vertical view, partially cut away, further illustrating the embodiment of the inventions shown in FIG. 4.

FIG. 4 illustrates the present invention as applicable to a wooden deck 50 or walkway adjacent to the swimming pool 10. In this environment, the ladder 14 is attached to the uni-directional pivoting joints 22 and 23 which are in turn securely fastened to the wooden deck 50. The uni-directional pivoting joints 22 and 23 must be modified in this case, as further shown by FIG. 5, in order to secure the ladder 14 to the wooden deck 50. Therefore, the modified lower adapter 40′ includes a mounting plate 51 to which the flange 41 is made an integral part. Wood screws 52, or other suitable mounting hardware are utilized to fasten the mounting plate 51 to the wooden deck 50.

Figure 6:
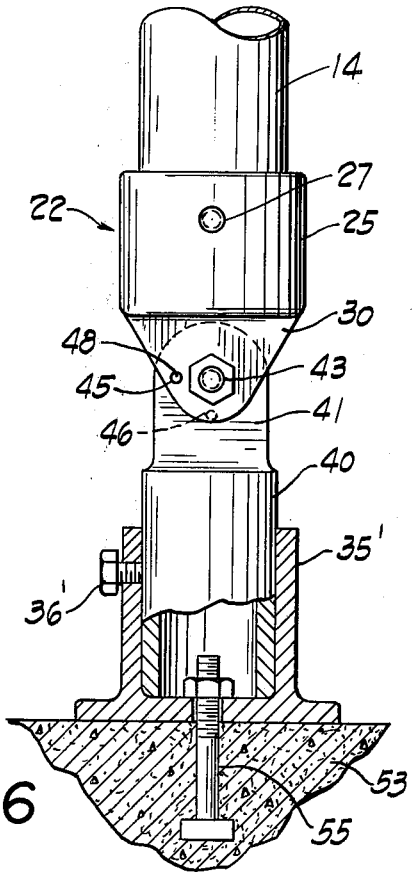
FIG. 6 is a partial vertical section illustrating still another preferred embodiment of this invention.

FIG. 6 illustrates the present invention in still another arrangement. Here, the material indicated at 53 is intended to represent concrete, wood, or any other suitably permanent structure. Assuming provisions for mounting apparatus, such as the ladder 14, were not provided for when the material 53 was located, an alternate mounting technique is necessary. Using the uni-directional pivoting joints 22 and 23 as discussed with regard to FIGS. 2 and 3, a modified socket 35′ is provided which enables the lower adapter 40 to be secured to the modified socket 35′ by way of a locking bolt 36′. The modified socket 35′ is then securely attached to the material 53 by reason of any suitable fastening device such as bolt 55.

Figure 7:
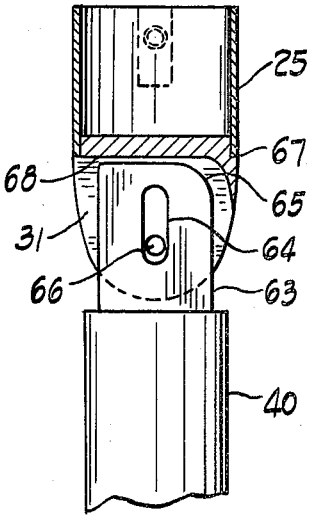
FIG. 7 is a partial section showing a further embodiment of this invention.

The embodiment of the uni-directional pivoting joint 22 illustrated in FIG. 7 is designed to enable the ladder to be automatically latched in the two positions as discussed above. In this case, the lower adapter 40 is secured into the deck 12 or the surface adjacent the pool 16 as explained above. A flange 63 is permanently fixed to the lower adapter 40 by any suitable means. The flange 63 is rectangular in shape and includes an elongated aperture 64 in a flat portion thereof with one of the upper corners 65 being rounded.

The upper adapter 25 again is utilized in the manner described above. The upper adapter 25 is designed as before with two opposing side walls 31 and 32 (only side wall 31 is shown in FIG. 7) resulting in an opening between the two which corresponds to the flange 63. The side walls 31 and 32 include concentric apertures, indicated at 66, through which a pin (not shown in the figures) or any other suitable fastening device secures the upper adapter 25 to the flange 63 through the elongated aperture 64. The upper adapter 25 additionally includes a web 67 at one end of a base 68 of the adapter 25 connecting the side walls 31 and 32.

When the ladder 14 is extended into the swimming pool the uni-directional pivoting joint 22 appears as shown in FIG. 7. In this manner, the bottom of the upper adapter 25 rests firmly upon the top edge of the flange 63. In this manner, the ladder 14 is latched in position and may be moved only upon being lifted vertically. As discussed above, the remaining end of the ladder 14 is supported against the wall 20 of the pool and thus weight may be supported on the ladder 14.

To remove the ladder 14 from within the swimming pool 10, the ladder 14 is pivoted about the pin (not shown) extending through the concentric apertures 66 and the elongated aperture 64. The upper adapter 25 pivots to the left with regard to FIG. 7. The ladder 14 is initially lifted vertically in order that the base 68 not be interfered with by the corner of the flange 63. The rounded upper corner 65 of the flange 63 is designed to allow for the web 67 to pass the flange 63 without interference. When the upper adapter 25 is pivoted to the left, the lower adapter 40 and the corner of the flange 63 contacting the web 67 support the ladder 14. The upper adapter 25 is unable to be pivoted to the right from this position without being vertically lifted due to the corner of the flange 63 contacting both the base 68 and the web 67 of the upper adapter 25. In this manner, the ladder is latched in the inoperative position 14′ as discussed above.

The pivoting joint as illustrated in FIG. 7 is additionally incapable of pivoting to the right by reason of the web 67 contacting the flange 63. The ladder 14 extends into the swimming pool 10 and rests against the vertical wall 20 of the pool when the pivoting joint is as shown in FIG. 7. In this position, the ladder 14 and thus the upper adapter 25 is not desired to be pivoted to the right as viewed in the figure. Such a movement would be impossible in any regard due to the ladder 14 contacting the vertical wall 20 of the pool 10.

Modifications, changes and improvements to the preferred forms of the invention herein disclosed, described and illustrated may occur to those skilled in the art who come to understand the principles and precepts thereof. Accordingly, the scope of the patent to be issued hereon should not be limited to the particular embodiments of the invention set forth herein, but rather should be limited only by the advance by which the invention has promoted the art.

I claim:

1. An article permanently connecting a ladder to a fixed structure, said article comprising pivoting means connecting one end of said ladder to said fixed structure, a first portion of said pivoting means attached to said ladder, a second portion of said pivoting means attached to said structure, means pivotally connecting said first and second portions of said pivoting means, and locking means for securing said first and second portions of said pivoting means to thereby prevent pivoting of said ladder, said locking means comprising flat abutting surfaces on said first and second portions of said pivoting means, said flat surfaces locatable to selectively lock said ladder in a plurality of positions with respect to said fixed structure, said means pivotally connecting said first and second portions including means providing substantial lineal movement of said portions of the pivoting means relative to each other in addition to said pivotal movement, whereby said ladder is capable of pivoting perpendicular to said structure into a plurality of stable positions with respect to said structure depending on the operation of said locking means.

2. A ladder for a swimming pool having water therein, at least one vertical wall and deck means adjacent thereto, said ladder comprising pivoting means securing the ladder to said deck means, said pivoting means allowing said ladder to be moved through a path perpendicular to said vertical wall and comprising a first portion attached to one end of said ladder, a second portion attached to said deck means, and means pivotally connecting said first and second portions of said pivoting means, locking means securing said first and second portions of said pivoting means to obtain at least two stable positions to thereby prevent pivoting of said ladder, a first of said stable positions resulting in the other end of said ladder being adjacent to said vertical wall below the level of said water and a second of said stable positions resulting in said other end of said ladder being positioned in a plane above the level of said water, said locking means comprising flat abutting surfaces on said first and second portions of said pivoting means, and said means pivotally connecting said first and second portions including means providing lineal movement of said first and second portions of said pivoting means relative to each other in addition to pivotal movement thereof.

3. The ladder according to claim 2 in which one said portion of said pivoting means comprises a vertical slot and the other said portion of said pivoting means comprises pin means extending through said vertical slot and being of substantially less height than the height of said slot to provide for relative lineal movement of said first and second portions and having a width relative to the width of said vertical slot providing for pivoting or rotation of said other portion relative to said one portion.

4. The ladder according to claim 3 in which a said portion includes flange means engaging another said portion when said pin means is disposed in said slot to position said portions in close proximity to prevent rotation of said first and second portions relative to each other and being free of said another portion when said pin is at the end of said slot to position said first and second portions in remote lineal relationship to permit rotation of said first and second portions relative to each other.

* * * * *